US008490673B2

(12) United States Patent
Defrocourt et al.

(10) Patent No.: US 8,490,673 B2
(45) Date of Patent: Jul. 23, 2013

(54) METHOD FOR DEBURRING A CERAMIC FOUNDRY CORE

(75) Inventors: Christian Defrocourt, Franconville (FR); Serge Prigent, Le Sappey en Chartreuse (FR); Daniel Quach, Fontenay Sous Bois (FR); Patrick Wehrer, Maisons Laffitte (FR)

(73) Assignee: SNECMA, Paris (FR)

( * ) Notice: Subject to any disclaimer, the term of this patent is extended or adjusted under 35 U.S.C. 154(b) by 381 days.

(21) Appl. No.: 12/988,447

(22) PCT Filed: Apr. 17, 2009

(86) PCT No.: PCT/EP2009/054591

§ 371 (c)(1), (2), (4) Date: Oct. 18, 2010

(87) PCT Pub. No.: WO2009/127721

PCT Pub. Date: Oct. 22, 2009

(65) Prior Publication Data

US 2011/0049748 A1 Mar. 3, 2011

(30) Foreign Application Priority Data

Apr. 18, 2008 (FR) ..... 08 02179

(51) Int. Cl.
*B22C 9/10* (2006.01)
*B22C 9/12* (2006.01)

(52) U.S. Cl.
USPC ..... 164/17; 164/28; 164/369

(58) Field of Classification Search
USPC ..... 164/17, 28, 69.1, 161, 369
See application file for complete search history.

(56) References Cited

U.S. PATENT DOCUMENTS

| | | | | |
|---|---|---|---|---|
| 4,579,705 | A | 4/1986 | Matsuoka et al. | |
| 5,465,780 | A * | 11/1995 | Muntner et al. | 164/516 |
| 5,714,242 | A | 2/1998 | Watanabe et al. | |
| 2004/0087256 | A1 | 5/2004 | Schwartz et al. | |

FOREIGN PATENT DOCUMENTS

| | | |
|---|---|---|
| EP | 0 708 067 | 4/1996 |
| JP | 7 256544 | 10/1995 |

OTHER PUBLICATIONS

SP3 INC: "Machining Guides for DIAbide Cutting Tools" URL:http://www.sp3cuttingtools.com/pdf/greencrm.pdf> [Retrieved on Jul. 14, 2009]. (Dec. 31, 2000).

International Search Report issued Aug. 4, 2009 in PCT/EP09/54591 filed Apr. 17, 2009.

* cited by examiner

*Primary Examiner* — Kevin P Kerns

(74) *Attorney, Agent, or Firm* — Oblon, Spivak, McClelland, Maier & Neustadt, L.L.P.

(57) ABSTRACT

A method for deburring a ceramic foundry core obtained by injecting a ceramic paste, the paste including a binder having a predetermined glass transition temperature, into a mold and having at least one surface portion with a surplus of material forming a burr to be eliminated. The method includes the following stages: a) disposing and attaching the molded, unfired foundry core onto a mounting; b) placing a milling tool, having an elongated shape with a helically cut edge, onto a tool holder; c) causing the tool to rotate around its axis and touching the milling tool to the surface portion to be deburred; and d) freezing the surface portion to be deburred such that the foundry core is maintained at a temperature lower than a glass transition temperature during the deburring operation.

10 Claims, 1 Drawing Sheet

METHOD FOR DEBURRING A CERAMIC FOUNDRY CORE

TECHNICAL FEILD

The present invention relates to the finishing of parts produced by injection-molding a ceramic slurry into a mold formed by assembling at least two parts along a parting line. The invention relates more specifically to the removal of flash from the area of the parting line of the two parts. The invention is concerned with ceramic cores used in the manufacture of hollow blades for turbine engines by the investment casting process.

BACKGROUD OF THE INVENION

The use of so-called "ceramic" foundry cores is particularly familiar in certain applications that require a range of severe quality characteristics and criteria such as resistance to high temperatures, lack of reactivity, dimensional stability, and good mechanical properties. As is known, applications having such demands include aeronautical applications and, for example, the manufacture by casting of turbine blades for jet engines. Advancement in molding processes from so-called equiaxed casting to directional solidification casting or monocrystalline casting has further ramped up these demands concerning cores whose use and complexity are necessitated by the search for high performance in the parts to be obtained, as is the case for example with internally cooled hollow blades.

The desired complex crystalline structure of the blade is incompatible with having flash on the core. Flash can become detached during casting and contaminate the part by creating inclusions and/or geometrical defects. A piece of flash that remains in place creates a fissure in the part and therefore a crack initiator. Cores therefore must be deflashed.

This operation is traditionally done by hand following firing. However, manual deburring of thin, complicated cores such as the cores of the moving blades of high-pressure (HP) stages or the fixed HP turbine nozzle assemblies, is more and more difficult to do accurately and reproducibly, because it has to be possible to do these high-precision operations on a production line. What is more, these repeated operations on cores can be harmful to the health of operators by giving rise of musculoskeletal disorders (MSDs).

Manual deburring can generate high levels of rejects with defects such as the following: incipient cracks, core breakages during handling, lack of reproducibility, and delamination of the core leading to inclusions in the metal parts.

Efforts have been made to automate the process of deburring the part after firing. However, the results are unsatisfactory because the deformation of the parts is poorly understood due to shrinkage after firing. This shrinkage makes deburring by machining very difficult and hard to automate.

SUMMARY

This problem is solved with a method, according to the invention, for deburring a ceramic foundry core obtained by injection-molding a ceramic slurry, said slurry containing a binder with a predetermined glass transition temperature, into a mold and having at least one surface portion with surplus material forming flash to be removed, said method being characterized in that it comprises the following steps:

a. arranging and securing the cast foundry core, before firing, on a support, b. placing a milling tool of elongate shape with a helical cutting edge on a toolholder, c. rotating the tool about its axis and bringing the milling tool into contact with said surface portion to be deflashed.

d. cooling the surface portion to be deflashed in such a way as to keep it at a temperature below said glass transition temperature during the deburring operation.

By means of the invention, by deburring before firing the foundry core, the problem of the dimensional variation of the core is avoided and the way is opened up to carry out this operation by means of a robot. This ensures better reproducibility of deburring from one core to the next, leading to better quality deburring and a decrease in the part breakage rate. A better quality core also means that the number of incipient cracks is reduced, leading to a decrease in manufacturing cycles and therefore a reduction in costs.

It is advantageous to use a milling tool with a helix angle of between 20° and 70° and a hemispherical tip. In this way, cut material is carried well away from the cutting zone, reducing the risk of clogging.

More particularly the cutting parameters are:

a cutting speed of between 5 and 30 m/min, a tool feed speed of between 300 and 2000 mm/min, and a tool rotation speed of between 2000 and 15000 rev./min.

In accordance with another feature, cooling is provided by diffusing a fluid toward the surface portion to be deflashed. This may be air, for example.

The method is particularly suitable for deburring ceramic cores for turbine engine blades. It results in particular in a decrease in incipient cracks in the cast products.

In order to implement the method, it is preferred to use equipment for finishing ceramic cores of mold parts comprising a support for said core, a toolholding chuck that is rotatable about its axis, and at least one cooling fluid injection nozzle.

BREIF DESRIPTION OF THE DRAWINGS

The method will now be described in more detail with reference to the appended drawings, in which.

DETAILED DESCRIPTION

Figure 1:
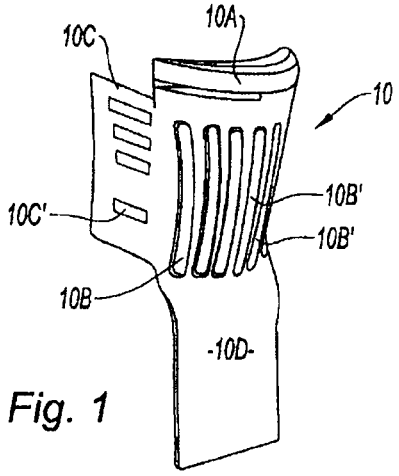
FIG. 1 is a diagram of a core for a turbine engine blade.

FIG. 1 shows an example of a part consisting of a core element for a hollow blade for a turbine engine. The envelope of this element 10 has the shape of the interior cavity of the hollow blade once the latter has melted away. The element 10 comprises an upper part 10A which will form the trough part of the blade. This part is separated from the central body 10B by a space which will form the transverse upper wall of the hollow blade. This central part 10B is continued downwards by the root 10D which serves to grip and secure the core in the shell mold into which the molten metal is poured. The central part is hollowed out by longitudinal openings 10B' which will form the internal partitions defining the channel for the cooling fluid through the blade cavity. The part 10B is continued laterally on one side by a thinner part of the trailing edge 10C and comprising openings 10C' that will form partitions setting out channels exiting along the blade trailing edge for the evacuation of the cooling fluid. The core is intended, after the metal has been cast and cooled, to be eliminated to expose the cavity through which the blade cooling air will flow.

Figure 2:
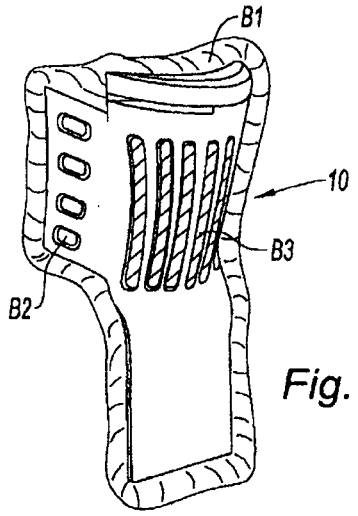
FIG. 2 shows the same core as FIG. 1 leaving the injection mold with flash which must be removed.

This rather complex part is produced by injection-molding a ceramic slurry with the aid of a press. The slurry is obtained by mixing a binder, an organic polymer, and particles of ceramic materials. The mixture is injected by means of injection presses, such as screw-type injection presses, into a metal injection mold. This mold is an assembly of at least two elements with impressions, which are brought into contact with each other along a meeting surface usually known as the parting line. During the injection the slurry progressively spreads from the inlet orifice through the volume defined by the impressions. However, some material creeps out between the surfaces of the parting line. On demolding, this surplus material forms the flash. FIG. 2 shows the appearance of the core from FIG. 1 as it comes out of the injection mold. The parts corresponding to the parting lines of the mold parts are extended by flash. For example, flash B1 can be seen around the outline of the core. Other flash B2 is visible around the inside edges of the holes 10C' in the area of the trailing edge 10C. Flash B3 can also be seen around the edges of the holes 10B' in the area 10B.

After injection molding, the rest of the core manufacturing method consists in demolding the core, firing it in a furnace at high temperature, finishing it and performing dimensional checking.

The purpose of finishing is to remove the flash B1, B2 and B3. Flash can be removed either immediately after injection of the mixture, that is deburring before firing, or after firing, in other words deburring the core in the fired state.

The normal manual deburring can introduce numerous defects as reported above.

Trials of automatic deburring using cutting tools such as milling cutters have been carried out on cores after firing. They do not give conclusive results owing in part to the fact that cores in the fired state have differing firing shrinkages. The position of the tool cannot therefore be defined accurately and reproducibly because of milling cutter wear due to the abrasion and hardness of the fired core. Areas 10A, 10B, 103', 10C and 10C' would need to be examined minutely before deburring.

In accordance with the invention, the material is removed before firing, on the part following injection molding of the polymer/ceramic mixture in order to eliminate said problems related with deformation of the part during and after firing.

The method of the invention defines core cutting parameters that take account of intrinsic properties of the material of the latter.

Specifically, the type of polymer binder that is mixed with the ceramic, e.g. polyethylene glycol, has properties that can change in the vicinity of room temperature, particularly a tendency to soften. This leads to clogging of the material when the material forming the flash is attacked with a conventional milling cutter. This clogging will eventually prevent further removal of the flash.

In accordance with one feature of the invention, a helical milling cutter, that is a cutter with a longitudinal cutting edge in the form of a helix, is used.

Figure 3:
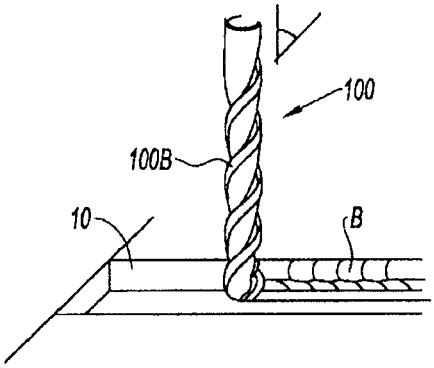
FIG. 3 shows a milling cutter removing the flash from the core.

Shown in FIG. 3 is the mode of application of the milling cutter 100 guided along the edge of the part 10 comprising flash. The cutting edge 1003 in the form of a longitudinal helix bites into the material forming the flash 3. Using this helical shape avoids the material becoming clogged along the cutter 100. The material is removed continuously and the chips are carried away.

The slope of the helix is defined by a helix angle $\alpha$ of between 20° and 70°, preferably between 35° and 65°.

The diameter of the milling cutter suitable for this operation, bearing in mind the narrow spaces formed by the holes, is between 0.5 and 1 mm. The tip of the milling cutter is preferably hemispherical.

In accordance with another feature of the invention, the flash material is maintained at a temperature below the glass transition temperature. One way is to provide nozzles blowing cool air at the moving end of the milling cutter. For example, for PEG the temperature is maintained at between 16 and 26° C.

As it rotates about itself, the tool is traversed along the flash that is to be removed. The cutting and feed speeds are adapted to the profile. For example, they differ between the outline and recess of the core, or the run-out grooves of the trailing edge.

By way of illustration, the cutting speed is between 5 and 25 m per minute and the feed speed is between 400 and 1800 mm per minute.

Figure 4:
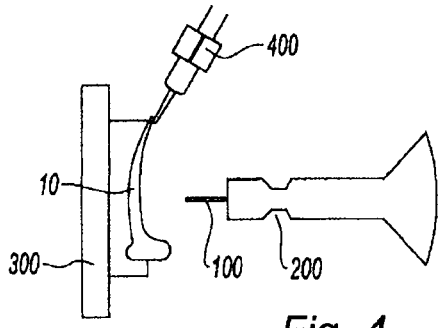
FIG. 4 is a diagram of a milling cutter in position for deburring a ceramic part.

FIG. 4 shows the relative position of the tool with respect to the part. The part 10 is secured to a support 300 in such a way that its outline is accessible to a milling cutter 100, which in turn is mounted on a chuck 200 forming a toolholder. The nozzle 400 for injecting air or any other suitable cooling fluid is aimed at the surface of the portion of the part to be deflashed.

Figure 5:
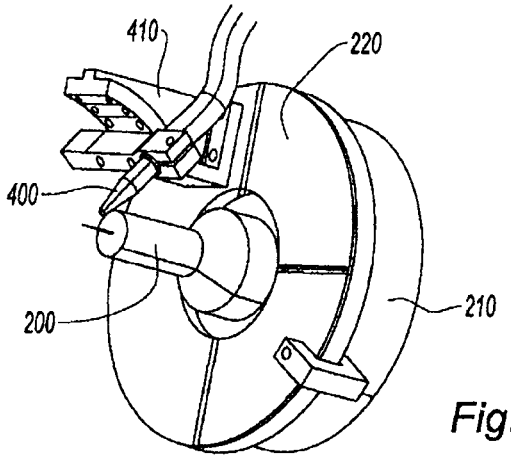
FIG. 5 shows a device in accordance with the invention.

FIG. 5 shows deburring equipment. The chuck 200 is fixed to a rotary support 210 which in turn may be mounted on a milling machine (not shown) with three axes for example. A stationary plate 220 acts as a support for the nozzle 400 via a bracket 410 whose position is adjustable. The plate may have multiple nozzles according to requirements.

The invention claimed is:

1. A method for deflashing a ceramic foundry core obtained by injection-molding a ceramic slurry, said slurry containing a binder and having a predetermined glass transition temperature, into a mold and having at least one surface portion with surplus material forming flash to be removed, said method comprising the steps of:

arranging and securing the ceramic foundry core, unfired and maintained below said glass transition temperature, on a support;

placing a milling tool of elongate shape with a helical cutting edge on a toolholder;

rotating the tool about an axis thereof and bringing the milling tool into contact with the at least one surface portion to be deflashed;

cooling the at least one surface portion to be deflashed in such a way as to keep the at least one surface portion at a temperature below said glass transition temperature during the deflashing operation.

2. The method as claimed in claim 1, wherein the milling tool has a helix angle of between 20° and 70° and a hemispherical tip.

3. The method as claimed in claim 2, wherein cutting parameters are a cutting speed of between 5 and 30 m/min, a tool feed speed of between 300 and 2000 mm/min, and a tool rotation speed of between 2000 and 15000 rev/min.

4. The method as claimed in claim 1, wherein cooling is provided by diffusing fluid toward the at least one surface portion to be deflashed.

5. The method as claimed in claim 4, wherein the cooling fluid is air.

6. The method as claimed in claim 1, wherein the ceramic foundry core is for a turbine engine blade.

7. The method as claimed in claim 1, further comprising the steps of:

providing a support for an unfired foundry core;

providing a toolholding chuck that is rotatable about the axis; and blowing a cooling fluid with an injection nozzle.

8. The method as claimed in claim 2, further wherein the helix angle is between 35° and 65°.

9. The method as claimed in claim 1, wherein cooling the at least one surface portion to be deflashed includes maintaining the temperature between 16° C. and 26° C.

10. The method as claimed in claim 1, further comprising the step of injecting ceramic slurry into the mold to form the ceramic foundry core.

* * * * *

UNITED STATES PATENT AND TRADEMARK OFFICE

CERTIFICATE OF CORRECTION

PATENT NO. : 8,490,673 B2
APPLICATION NO. : 12/988447
DATED : July 23, 2013
INVENTOR(S) : Christian Defrocourt et al.

It is certified that error appears in the above-identified patent and that said Letters Patent is hereby corrected as shown below:

In the Specifications

Column 3, line 42, change "103'," to --10B',--
line 63, change "1003" to --100B--
line 64, change "flash 3." to --flash B.--

Signed and Sealed this
Eighteenth Day of February, 2014

Michelle K. Lee

Michelle K. Lee
*Deputy Director of the United States Patent and Trademark Office*